US012736227B2

(12) United States Patent
Dinkel et al.

(10) Patent No.: US 12,736,227 B2
(45) Date of Patent: Sep. 15, 2026

(54) HOUSEHOLD COOKING APPLIANCE

(71) Applicant: BSH Hausgeräte GmbH, Munich (DE)

(72) Inventors: Alexander Dinkel, Unterwoessen (DE); Ragnar Somdalen, Vachendorf (DE); Wolfgang Hörner, Traunstein (DE)

(73) Assignee: BSH Hausgeräte GmbH, Munich (DE)

( * ) Notice: Subject to any disclaimer, the term of this patent is extended or adjusted under 35 U.S.C. 154(b) by 697 days.

(21) Appl. No.: 18/035,958

(22) PCT Filed: Nov. 17, 2021

(86) PCT No.: PCT/EP2021/081997

§ 371 (c)(1),
(2) Date: May 9, 2023

(87) PCT Pub. No.: WO2022/106473

PCT Pub. Date: May 27, 2022

(65) Prior Publication Data

US 2023/0408103 A1 Dec. 21, 2023

(30) Foreign Application Priority Data

Nov. 20, 2020 (DE) ..... 102020214630.6
Nov. 12, 2021 (DE) ..... 102021212765.7

(51) Int. Cl.
*F24C 15/16* (2006.01)
*F24C 7/04* (2021.01)
(Continued)

(52) U.S. Cl.
CPC ..... *F24C 15/16* (2013.01); *F24C 7/046* (2013.01); *F24C 7/062* (2013.01); *F24C 7/067* (2013.01);
(Continued)

(58) Field of Classification Search
CPC ..... F24C 15/16; F24C 7/046; F24C 7/062; F24C 7/067; F24C 15/007; F24C 15/322;
(Continued)

(56) References Cited

U.S. PATENT DOCUMENTS

2002/0060215 A1 5/2002 Allera
2004/0040447 A1* 3/2004 Lee ..... H05B 6/645 99/446
(Continued)

FOREIGN PATENT DOCUMENTS

DE 4217545 A1 12/1993
DE 102010062504 A1 6/2012
(Continued)

OTHER PUBLICATIONS

National Search Report DE 10 2021 212 765.7 dated Oct. 5, 2022.
(Continued)

*Primary Examiner* — Tiffany T Tran
(74) *Attorney, Agent, or Firm* — Michael E. Tschupp; Andre Pallapies; Brandon G. Braun

(57) ABSTRACT

A household cooking appliance includes a cooking compartment for receiving food to be cooked, a cooking compartment divider received in the cooking compartment for dividing the cooking compartment into different cooking compartment sections and designed for removal from the cooking compartment, and an identifying facility configured to identify the cooking compartment divider in the cooking compartment and to adapt an operating state of the household cooking appliance to the cooking compartment divider in response to an identification of the cooking compartment divider.

12 Claims, 7 Drawing Sheets

(51) Int. Cl.
*F24C 7/06* (2006.01)
*F24C 15/00* (2006.01)
*F24C 15/32* (2006.01)

(52) U.S. Cl.
CPC ..... *F24C 15/007* (2013.01); *F24C 15/322* (2013.01); *F24C 15/325* (2013.01)

(58) Field of Classification Search
CPC ..... F24C 15/325; F24C 7/085; F24C 15/008; F24C 15/166
USPC ..... 426/233; 99/421 H, 445
See application file for complete search history.

(56) References Cited

U.S. PATENT DOCUMENTS

2006/0096969 A1* 5/2006 Kim ..... F24C 7/082 219/394
2009/0090347 A1 4/2009 Kim
2012/0067334 A1 3/2012 Kim
2013/0260618 A1 10/2013 Bally
2016/0095469 A1* 4/2016 Gregory ..... F24C 15/166 99/421 H
2020/0085237 A1 3/2020 Gregory

FOREIGN PATENT DOCUMENTS

DE 102010062505 A1 6/2012
DE 102010062511 A1 6/2012
DE 102011010239 A1 8/2012
EP 2295869 A2 3/2011
EP 2299181 A1 * 3/2011 ..... F24C 15/166
EP 2431667 A1 3/2012
JP H07217912 A 8/1995

OTHER PUBLICATIONS

International Search Report PCT/EP2021/081997 dated Feb. 17, 2022.
National Search Report EP 21 819 047.8 dated Jul. 18, 2024.
National Search Report CN 202180077874.5 dated Jul. 18, 2025.

* cited by examiner

HOUSEHOLD COOKING APPLIANCE

CROSS-REFERENCES TO RELATED APPLICATIONS

This application is the U.S. National Stage of International Application No. PCT/EP2021/081997, filed Nov. 17, 2021, which designated the United States and has been published as International Publication No. WO 2022/106473 A1 and which claims the priorities of German Patent Applications, Serial Nos. 10 2020 214 630.6, filed Nov. 20, 2020 and 10 2021 212 765.7, filed Nov. 12, 2021, pursuant to 35 U.S.C. 119(a)-(d).

The contents of International Application No. PCT/EP2021/081997 and German Patent Applications, Serial Nos. 10 2020 214 630.6 and 10 2021 212 765.7 are incorporated herein by reference in their entireties as if fully set forth herein.

BACKGROUND OF THE INVENTION

The present invention relates to a household cooking appliance.

A household cooking appliance, such as for example an oven, comprises a cooking compartment that is surrounded by a muffle or an oven muffle and a door is movably fastened to the cooking compartment. With the aid of a so-called cooking compartment divider, it is possible to divide the cooking compartment horizontally into at least two cooking compartment sections that are separated from one another and that can be used independently of one another.

The publication DE 42 17 545 A1 describes an electric baking and roasting oven having a cooking compartment that can be closed by a door and that can be divided into two cooking compartment regions that are separated from one another by a plate that can be inserted into the cooking compartment. The plate that can be connected to a power supply is equipped with a heating body for the bottom heat of the upper cooking compartment region, wherein this cooking compartment region has on the ceiling side a heating body for the top heat.

BRIEF SUMMARY OF THE INVENTION

Against this background an object of the present invention is to provide an improved household cooking appliance.

Accordingly, a household appliance is proposed, in particular a household oven, having a cooking compartment for receiving food to be cooked, a cooking compartment divider, which can be removed from the cooking compartment, for dividing the cooking compartment into different cooking compartment sections, and an identifying facility for identifying the cooking compartment divider that is received in the cooking compartment, wherein the identifying facility is configured so as to adapt an operating state of the household cooking appliance to the cooking compartment divider that is identified.

Due to the fact that the identifying facility is provided and the operating state of the household cooking appliance can be adapted to the cooking compartment divider that is identified, it is possible to omit a manual adaptation of the operating state. This can be performed for example due to the fact that if the cooking compartment divider is located in the cooking compartment, it is only possible to perform specific cooking procedures or cooking programs that are suitable for an operation using cooking compartment dividers.

The household cooking appliance can be for example a stove, an oven, a microwave combination oven, a double oven or the like. It is preferred that a door is pivotably fastened to the cooking compartment. For this purpose, it is possible to provide hinges. The door can alternatively also be arranged on an oven carriage or the like that can be pulled out of the cooking compartment. In this case, the door is not pivotably fastened to the cooking compartment but rather can be displaced in a linear manner with respect to this cooking compartment. The cooking compartment is preferably cube-shaped or cuboid and comprises a floor, a ceiling that is arranged lying opposite the floor, a rear wall that is arranged lying opposite the closed door and two side walls that are arranged lying opposite one another.

The cooking compartment divider is configured in particular so as to divide the cooking compartment horizontally into a first or upper cooking compartment section and into a second or lower cooking compartment section. The cooking compartment sections can be used independently of one another. In particular, the cooking compartment divider is an active cooking compartment divider. The fact that the cooking compartment divider is "active" is to be understood in the present case in particular to mean that the cooking compartment divider itself has a function, for example a heating function. "Active" in particular means that electrical and/or electronic components are provided.

The identifying facility can be part of a control facility of the household cooking appliance. In particular, the identifying facility is at least operatively connected or coupled to the control facility. The identifying facility is in particular suitable so as to identify or to determine whether the cooking compartment divider is located in the cooking compartment or not. The operating state is accordingly adapted depending on whether the cooking compartment divider is located in the cooking compartment or not.

For example, the household cooking appliance is operated in a normal mode if the identifying facility identifies that a cooking compartment divider is not located in the cooking compartment. If the identifying facility conversely in this regard identifies the cooking compartment divider, for example it is possible to perform a cooking procedure or a cooking program in which the different cooking compartment sections can be heated differently.

In particular, the identifying facility with the aid of the control facility is suitable for adapting or influencing the operating state of the household appliance. The fact that the operating state of the household cooking appliance is "adapted" to the identified cooking compartment divider in the present case in particular means that the household appliance is operated differently or outputs different display options in dependence upon whether the cooking compartment divider is located in the cooking compartment or not.

In accordance with one embodiment, the identifying facility is suitable so as to mechanically and/or electronically identify the cooking compartment divider.

A mechanical identification can be realized for example with the aid of one or multiple switches. The one or the multiple switches can be actuated with the aid of different plungers or plunger lengths. In this case, the number of switches is arbitrary. An electronic identification can be performed for example via a resistance measurement at an electrical and/or electronic component of the cooking compartment divider. An electronic identification is also possible with the aid of sensors.

In accordance with a further embodiment, the operating state of the household cooking appliance comprises a cooking procedure and/or display options.

For example, the cooking procedure or a cooking program is adapted in such a manner that in the case of a cooking compartment divider being present, a different temperature control is performed than without the cooking compartment divider. Display options can be displayed for example on a notification display of the household cooking appliance. With the aid of the notification display it is possible for example to display whether the cooking compartment divider is located in the cooking compartment or not. Where appropriate, it is also possible that the identifying facility identifies different accessory units of the cooking compartment divider and can differentiate the different accessory units from one another and accordingly changes or adapts the operating state.

In accordance with a further embodiment, the cooking compartment divider has a base unit that is guided in a movable manner on guide rails of the cooking compartment.

It is preferred that the guide rails are provided on the side on the side walls of the cooking compartment. The guide rails can be removable from the cooking compartment. A guide rail of this type is allocated to each side wall. The base unit has a frame-shaped base carrier that is guided on the guide rails. The base carrier preferably has a central opening in which an electrical and/or electronic component, for example a heating element, is received.

In accordance with a further embodiment, the base unit has an electrical and/or electronic component, in particular a heating element, wherein the identifying facility is configured so as to identify the electronic and/or electronic component.

As mentioned above, the electrical and/or electronic component can be a heating element. The electrical and/or electronic component can however also be a sensor or the like. The identifying facility is configured in particular so as to determine or to identify the electrical and/or electronic component in a contactless manner.

In accordance with a further embodiment, the identifying facility is configured so as to perform an electrical resistance measurement on the electrical and/or electronic component in order to identify the electrical and/or electronic component.

For example, the electrical and/or electronic component has a plug that is connected to a corresponding mating plug when the cooking compartment divider is inserted into the cooking compartment. With the aid of the electrical resistance measurement, it is possible to identify different electrical and/or electronic components. For example, multiple base units having different electrical and/or electronic components can be provided that differ from one another for example in their heating power. The identifying facility is then configured so as to differentiate the different base units from one another.

In accordance with a further embodiment, the cooking compartment divider has an accessory unit, in particular an insulation unit, a grill unit and/or a pizza baking unit that is connected to the base unit in a detachable manner.

It is possible to provide multiple different accessory units. The accessory units are preferably plate shaped. For example, an accessory unit can be attached to the base unit. Alternatively, it is also possible for multiple accessory units to be attached to the base unit simultaneously.

In accordance with a further embodiment, the base unit has connecting elements, in particular guide rails, with the aid of which the accessory unit is connected to the base unit in a detachable manner.

It is preferred that two guide rails of this type are provided that are attached on the side to the above-mentioned base carrier of the base unit. The guide rails can be C-shaped or U-shaped in cross section. Depending on the requirement, one of the accessory units can be inserted into the connecting elements of the base unit in a drawer-like manner in order thus to connect the respective accessory unit to the base unit. The connection between the respective accessory unit and the base unit is positive-fit. A positive-fit connection is provided by the engagement into or behind at least two connecting partners. A positive-fit connection can be arbitrarily detached again.

In accordance with a further embodiment, the identifying facility is configured so as to identify the base unit and/or the accessory unit.

In particular, the identifying facility can identify whether the base unit is inserted into the cooking compartment with or without an accessory unit. For example, an operation of the cooking compartment divider without an accessory unit can thus be identified and prevented.

In accordance with a further embodiment, the identifying facility is configured so as to identify a model variant of the accessory unit and to adapt the operating state of the household cooking appliance to the model variant that is identified.

The term a "model variant" or a "type" of the accessory unit in the present case is in particular to be understood to mean that each accessory unit can have a function that is allocated to the accessory unit, for example in the form of an insulation unit, a grill unit and/or a pizza baking unit. Different model variants accordingly have different functions.

Further possible implementations of the household cooking appliance also comprise combinations, which are not explicitly mentioned, of features or embodiments that are described above or below in relation to the exemplary embodiments. In this case, the person skilled in the art will also add individual aspects as improvements or additions to the respective basic form of the household cooking appliance.

BRIEF DESCRIPTION OF THE DRAWINGS

Further advantageous embodiments and aspects of the household appliance are the subject matter of the subordinate claims and also of the exemplary embodiments of the household cooking appliance that are described below. The household cooking appliance is further explained below with the aid of preferred embodiments with reference to the attached figures.

DETAILED DESCRIPTION OF EXEMPLARY EMBODIMENTS OF THE PRESENT INVENTION

Figure 1:
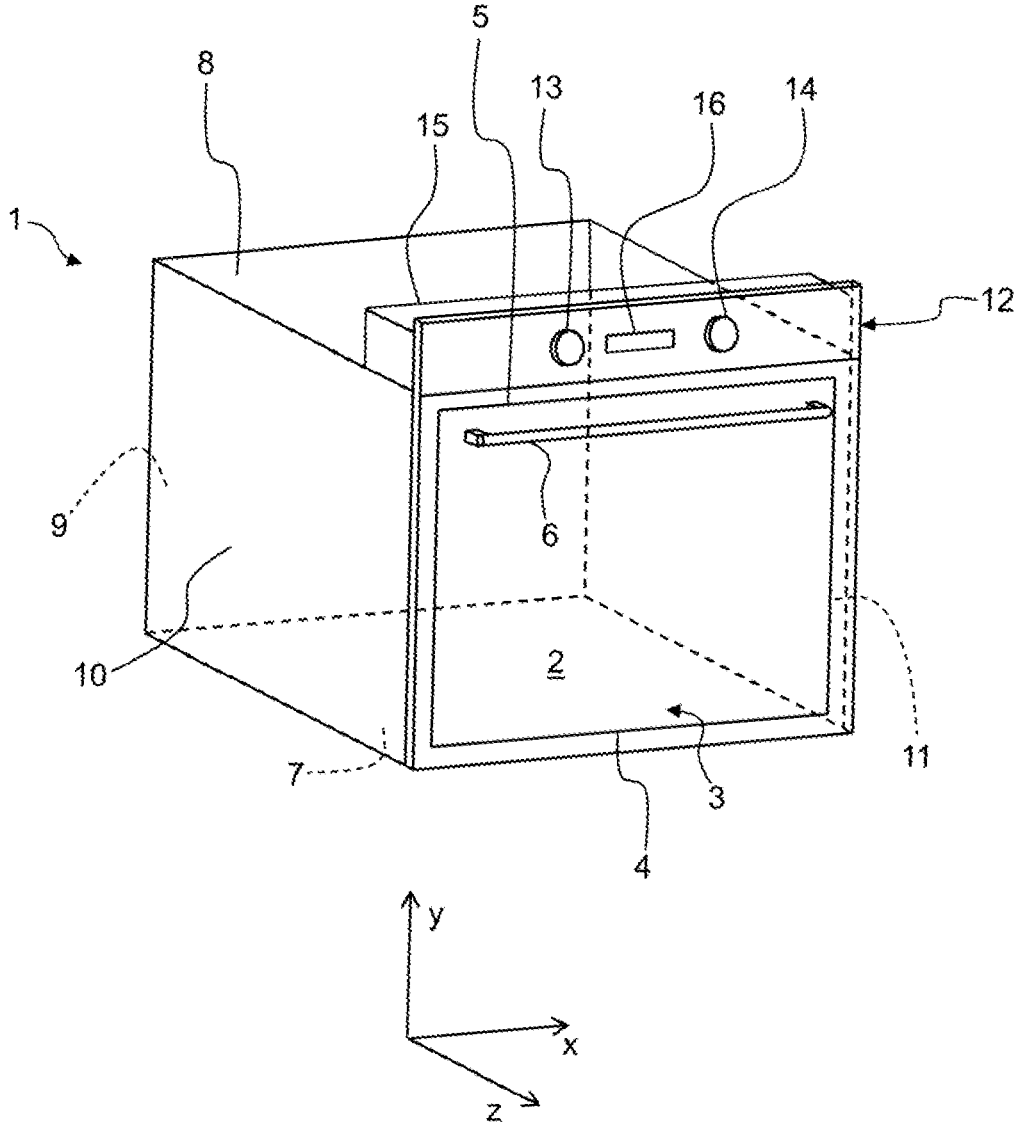
FIG. 1 shows a schematic perspective view of an embodiment of a household cooking appliance.

In the figures, identical or functionally identical elements have been provided with the same reference characters provided that nothing else is indicated.

FIG. 1 illustrates a schematic perspective view of an embodiment of a household cooking appliance 1. The household cooking appliance 1 can be a stove, an oven, a microwave combination oven, a double oven or the like. The household cooking appliance 1 has a cooking compartment 2 that can be closed with the aid of a door 3. The cooking compartment 2 can also be referred to as a muffle or oven muffle. The cooking compartment 2 can be arranged in the interior of a housing of the household cooking appliance 1.

The door 3 is illustrated in FIG. 1 in a closed position. The door 3 can be closed or opened by pivoting about a pivoting axis that is provided on a lower end of the door 3 or on a lower edge 4 of the door 3. Alternatively, the door 3 can be fastened to the side of the cooking compartment 2. Moreover, the door 3 can be arranged on an oven carriage that can be pulled out of the cooking compartment 2. The movement type of the door 3 when the door 3 is opened however can be selected arbitrarily. This means that the door 3 in principle can perform any arbitrary movement when the door is opened.

It is possible to provide a handle 6 on an upper section or on an upper edge 5 of the door 3. The door 3 can however also be handleless. The cooking compartment 2 has a floor 7, a ceiling 8 that is arranged lying opposite the floor 7, a rear wall 9 that is arranged lying opposite the door 3 and two side walls 10, 11 that are arranged lying opposite one another. The cooking compartment 2 is preferably cube-shaped or cuboid. The cooking compartment 2 can be produced from a metal material, in particular from sheet steel.

The household cooking appliance 1 furthermore comprises control knobs 13, 14 that are provided on a switch panel or control panel 12. The control knobs 13, 14 can be for example rotatable. On the rear side on the control panel 12 it is possible to provide a control facility 15, which is only illustrated schematically, for controlling the household cooking appliance 1. The control facility 15 can be a regulating facility and/or control facility. Furthermore, a notification display 16 can be provided on the control panel 12. With the aid of the notification display 16, it is possible to display an operating state of the household cooking appliance 1. For example, it is possible with the aid of the notification display 16 to display a temperature that is set with the aid of the control knobs 13, 14.

A coordinate system having a width direction or x-direction x, a height direction or y-direction y and a depth direction or z-direction z is allocated to the household cooking appliance 1 or to the cooking compartment 2. The directions x, y, z are oriented perpendicular to one another. The x-direction x is oriented from the side wall 10 in the direction of the side wall 11. The y-direction y is oriented from the floor 7 in the direction of the ceiling 8. The z-direction z is oriented from the rear wall 9 in the direction of the closed door 3.

Figure 2:
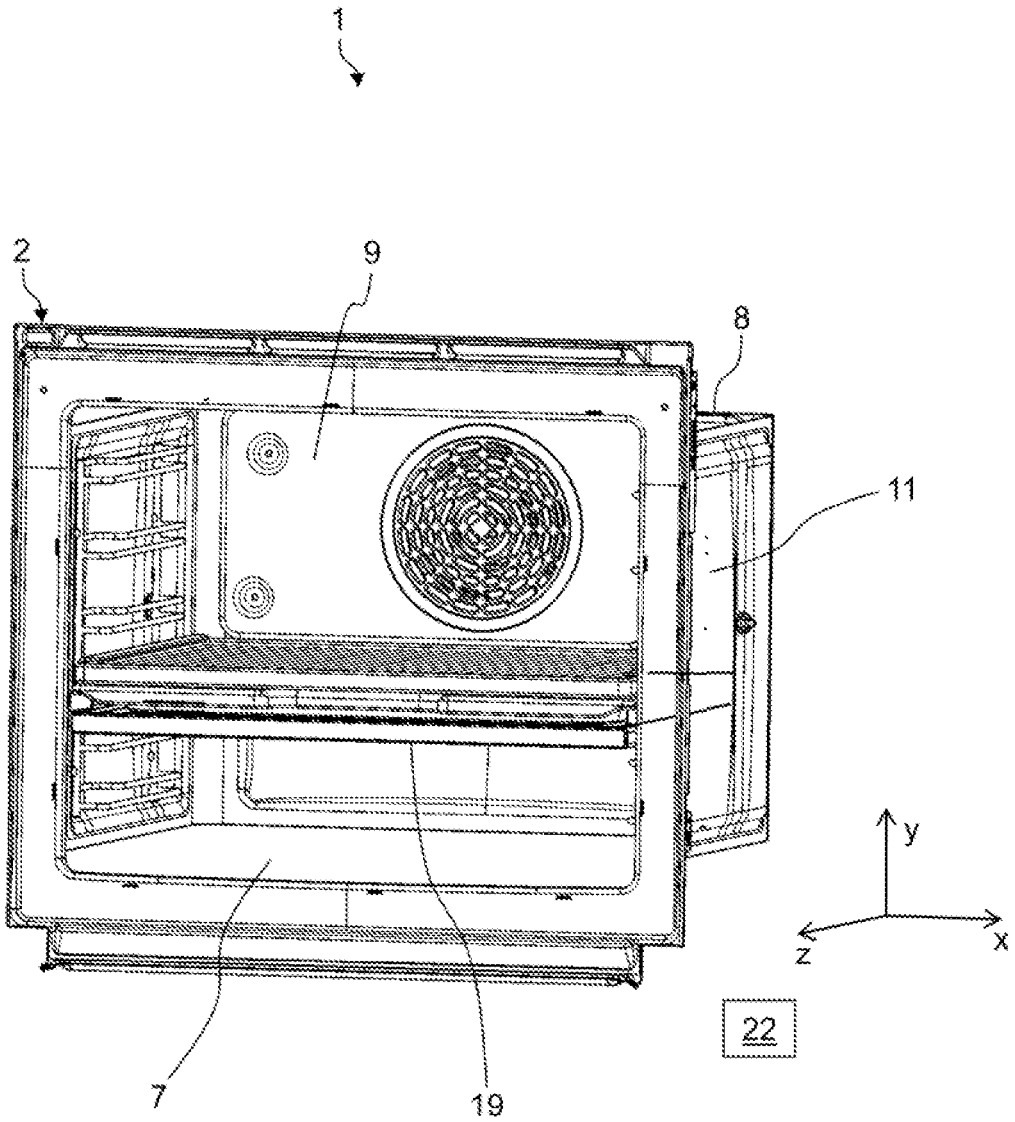
FIG. 2 shows a further schematic perspective view of the household cooking appliance in accordance with FIG. 1.
Figure 3:
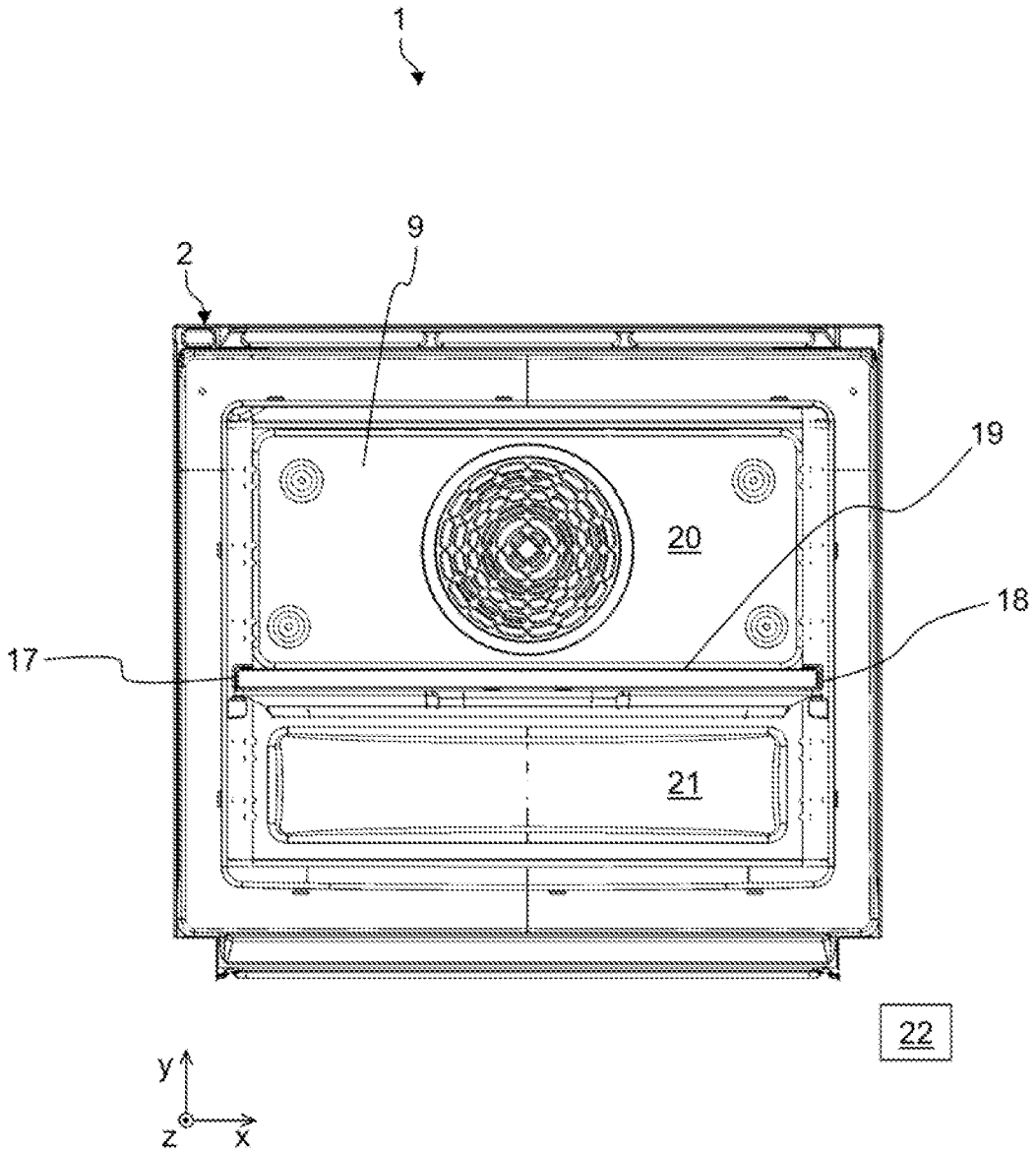
FIG. 3 shows a schematic front view of the household cooking appliance in accordance with FIG. 1.

FIG. 2 illustrates a further schematic perspective view of the household cooking appliance 1. FIG. 3 illustrates a schematic front view of the household cooking appliance 1. Reference is made below to FIGS. 2 and 3 simultaneously.

Guide rails 17, 18 are provided on the two side walls 10, 11 and a cooking compartment divider 19 is held in the cooking compartment 2 with the aid of the guide rails. A first guide rail 17 and a second guide rail 18 are provided. The guide rails 17, 18 are also suitable for example for carrying a baking tray. The cooking compartment divider 19 can be removed from the cooking compartment 2.

The cooking compartment divider 19 divides the cooking compartment 2 into an upper or first cooking compartment section 20 and a lower or second cooking compartment section 21. The cooking compartment divider 19 consequently divides the cooking compartment 2 horizontally into the first cooking compartment section 20 and the second cooking compartment section 21. "Horizontally" in this case means in a plane that spans from the x-direction x and the z-direction z.

The household cooking appliance 1 furthermore comprises an identifying facility 22 for identifying the cooking compartment divider 19. This means in particular that the identifying facility 22 is configured so as to identify whether the cooking compartment divider 19 is located in the cooking compartment 2 or not. This identification can be performed for example mechanically and/or electronically. A "mechanical" identification is possible for example with the aid of switches and/or plungers. An "electronic" identification can be achieved for example with the aid of suitable sensors or also with the aid of a resistance measurement.

The identifying facility 22 can be part of the control facility 15. The identifying facility 22 is at least operatively connected to the control facility 15 with the result that the identifying facility 22 is configured so as to adapt an operating state of the household cooking appliance 1 to the identified cooking compartment divider 19. This means in particular that an adaptation of the operating state of the household cooking appliance 1 is only then required if the cooking compartment divider 19 is located in the cooking compartment 2 and is identified by the identifying facility 22.

The fact that the operating state is "adapted" in the present case is to be understood to mean in particular that for example a cooking procedure or a cooking program can be influenced by a corresponding control of heating elements in such a manner that only the first cooking compartment section 20 and not the second cooking compartment section 21 is actively heated. It is also possible during a cooking procedure to adapt a temperature control to the cooking compartment divider 19 that is identified.

The operating state can however also comprise display options. This means for example that with the aid of the notification display 16 it is possible to display that the cooking compartment divider 19 is located in the cooking compartment 2. The "operating state" in the present case can also accordingly be understood to mean the point of a baking procedure or baking program that the household cooking appliance 1 is in.

Figure 4:
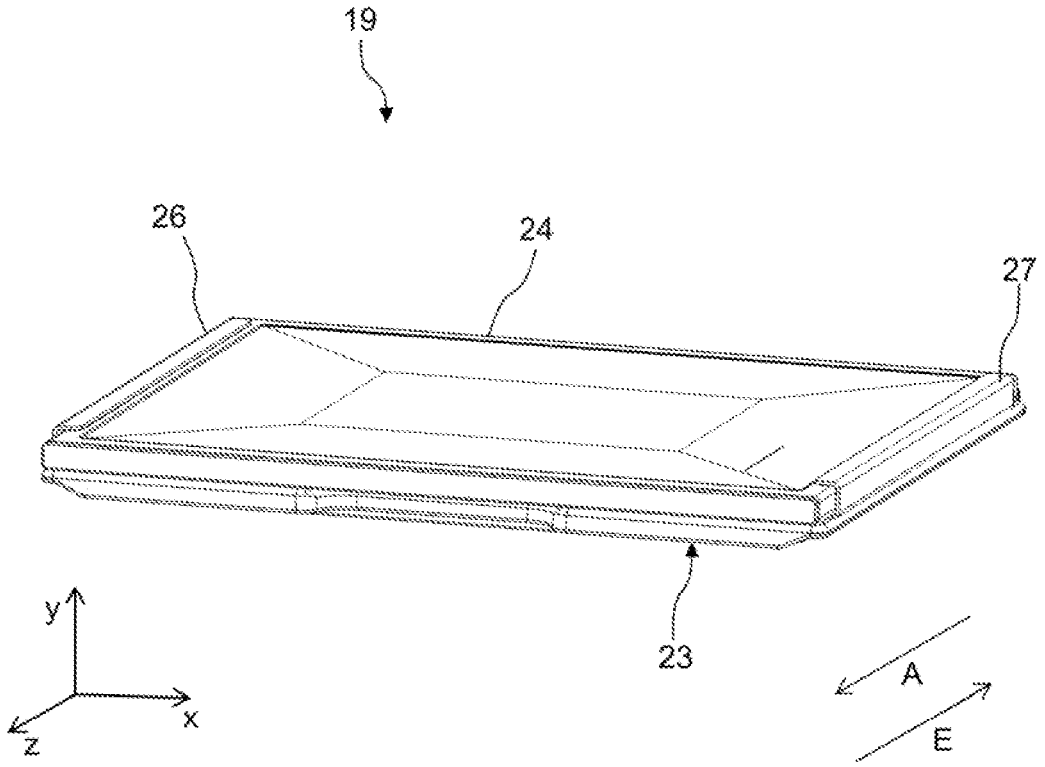
FIG. 4 shows a schematic perspective view of an embodiment of a cooking compartment divider for the household cooking appliance in accordance with FIG. 1.
Figure 5:
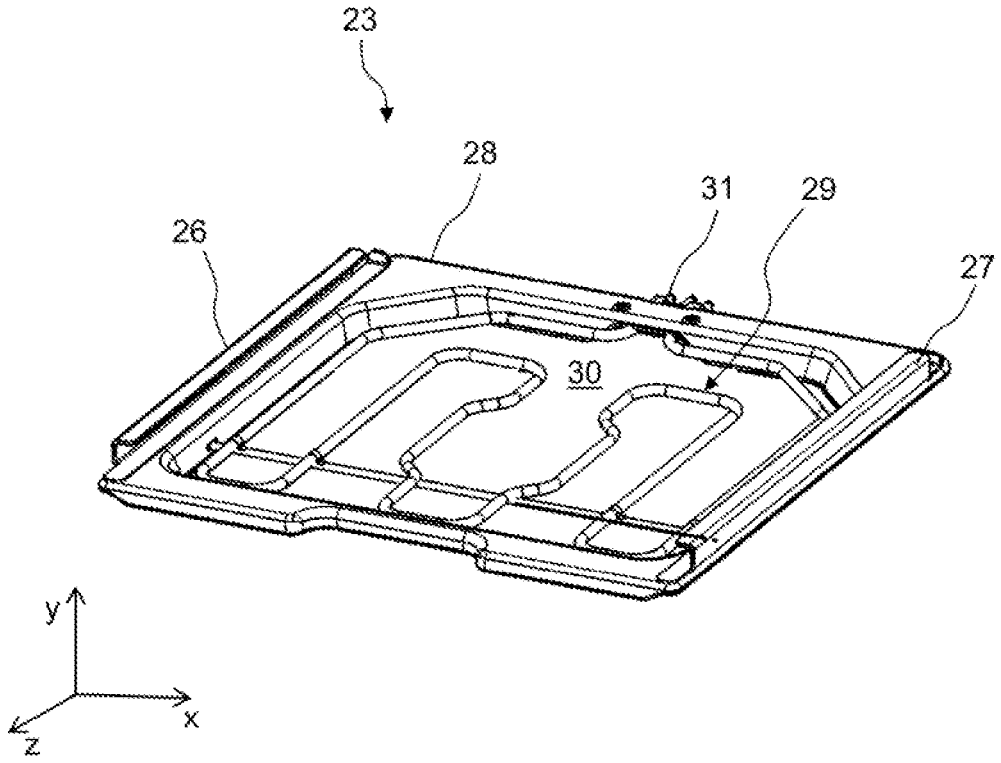
FIG. 5 shows a schematic perspective view of an embodiment of a base unit for the cooking compartment divider in accordance with FIG. 4.
Figure 6:
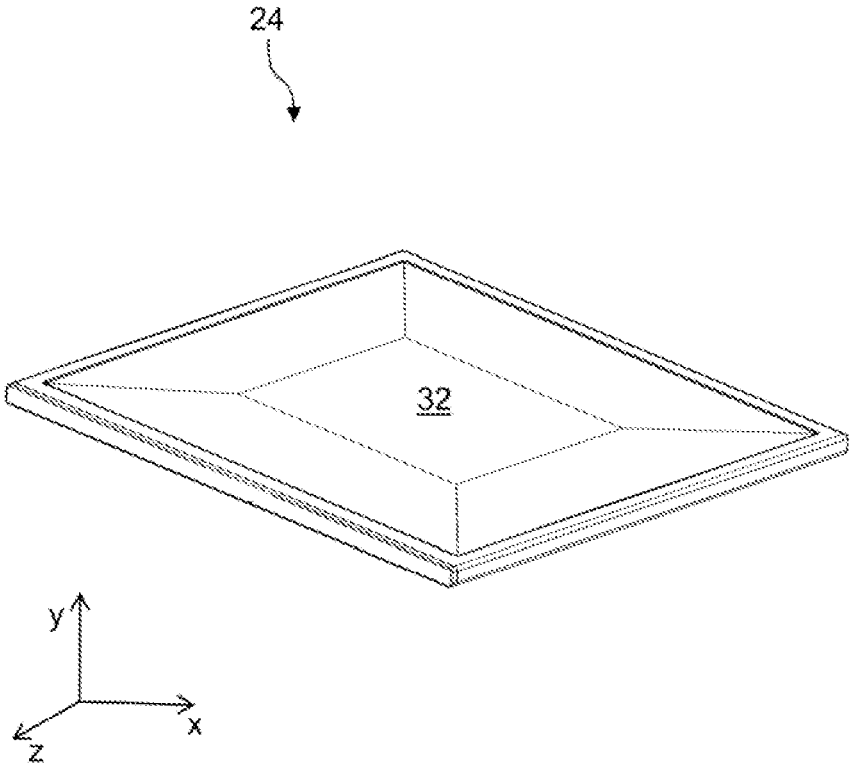
FIG. 6 shows a schematic perspective view of an embodiment of an accessory unit for the cooking compartment divider in accordance with FIG. 4.
Figure 7:
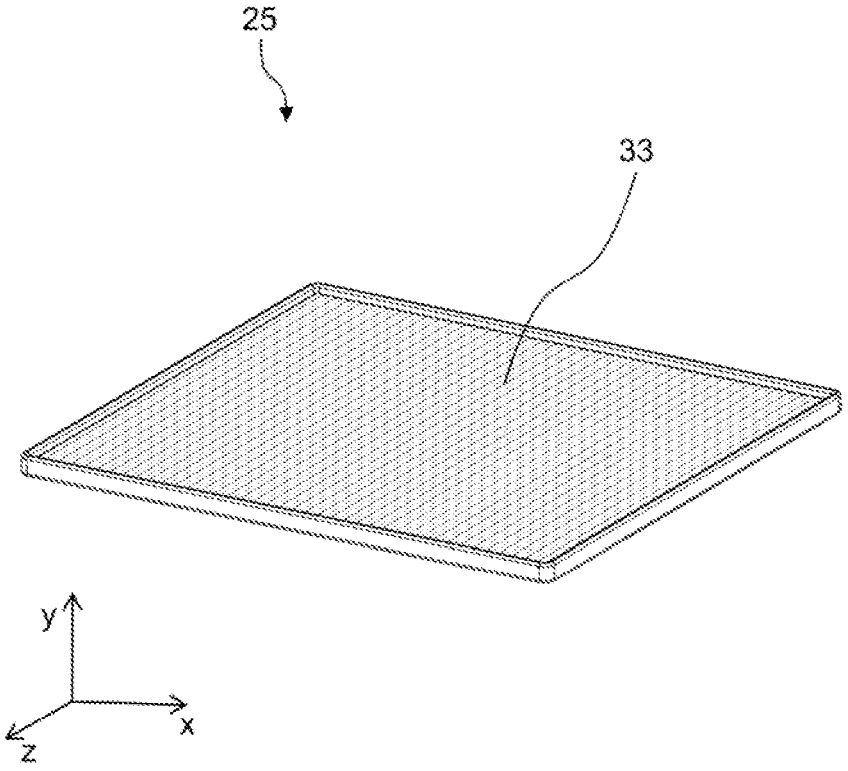
FIG. 7 shows a schematic perspective view of a further embodiment of an accessory unit for the cooking compartment divider in accordance with FIG. 4.

FIG. 4 illustrates a schematic perspective view of an embodiment of a cooking compartment divider 19 that is mentioned above. FIG. 5 illustrates a schematic perspective view of an embodiment of a base unit 23 for the cooking compartment divider 19. FIG. 6 illustrates a schematic perspective view of an embodiment of a first accessory unit 24 for the cooking compartment divider 19. FIG. 7 illustrates a schematic perspective view of an embodiment of a second accessory unit 25 for the cooking compartment divider 19. Reference is simultaneously made below to FIGS. 4 to 7.

The cooking compartment divider 19 comprises the base unit 23 and at least one of the accessory units 24, 25. At least one accessory unit 24, 25 is provided. The base unit 23 is guided with the aid of the guide rails 17, 18 in the cooking compartment 2. The respective accessory unit 24, 25 is connected in a positive-fit manner to the base unit 23. A positive-fit connection results due to the engagement into or behind at least two connecting partners, in the present case the base unit 23 and one of the accessory units 24, 25. A positive-fit connection can be detached any number of times and re-established.

The base unit 23 comprises connecting elements 26, 27, in particular guide rails, and the respective accessory unit 24, 25 is connected in a detachable manner with the aid of the connecting elements to the base unit 23. A first connecting element 26 and a second connecting element 27 are provided. In particular, the respective accessory unit 24, 25 can be pulled out in a direction of extraction A from the base unit 23. Accordingly, the respective accessory unit 24, 25 can be inserted in a direction of insertion E into the base unit 23. The direction of extraction A and the direction of insertion E are oriented parallel to the z-direction z.

The base unit 23 comprises a frame-shaped carrier element 28 that is guided on the guide rails 17, 18 of the cooking compartment 2. The two connecting elements 26, 27 are provided on the side of the carrier element 28. The connecting elements 26, 27 are preferably C-shaped or U-shaped in cross section. The carrier element 28 carries an electrical and/or electronic component 29. The component 29 is placed in an opening 30 of the carrier element 28, which penetrates the frame-shaped carrier elements 28.

The component 29 in the present case is a meandering curved heating element, in particular a tubular heating element. The component 29 comprises a plug 31 for energizing the component 29. The plug 31 can be inserted into a corresponding mating plug that can be provided on the rear wall 9 of the cooking compartment 2. The identifying facility 22 is coupled to the component 29, in particular to the plug 31. The identifying facility 22 can consequently identify the component 29, for example with the aid of a resistance measurement.

The first accessory unit 24 is preferably a plate-shaped insulation element or insulating element. The first accessory unit 24 covers the component 29 upwards in the direction of the first cooking compartment section 20. Heat from the component 29 is consequently preferably introduced essentially downwards into the second cooking compartment section 21. The first accessory unit 24 can have a central depression 32. Fluid can collect in the depression 32. Moreover, a container for food to be cooked or the like can also be placed in the depression 32.

The second accessory unit 25 is preferably a grill plate. The second accessory unit 25 can likewise be inserted into the connecting elements 26, 27 of the base unit 23. The second accessory unit 25 is preferably produced from a coated aluminum alloy. The second accessory unit 25 is likewise plate-shaped and can have ribs 33 that extend along the z-direction z. Moreover, an accessory unit 24, 25 can also be provided in the form of a pizza plate or a pizza stone.

Furthermore, it is possible to provide connecting elements 26, 27 on the carrier element 28 of the base unit 23 not just, as is illustrated in FIG. 5, on the upper side but rather connecting elements 26, 27 of this type can also be attached on the lower side to the carrier element 28. In this case, the component 29 is then placed between two accessory units 24, 25 that are attached to the base unit 23 on the upper side and lower side.

The identifying facility 22 is configured so as to identify a model variant or a type of the respective accessory unit 24, 25. For example, if it is identified that the second accessory unit 25 is a grill plate, it is then possible to accordingly execute a grilling program. For example, the above-mentioned insulation unit, the grill plate or the pizza stone are used as different model variants or types of the accessory unit 24, 25.

The cooking compartment divider 19 can consequently be identified for example due to a resistance measurement. This is in particular then possible to perform if the cooking compartment divider 19 has a component 29, for example in the form of a heating element. The cooking compartment divider 19 can additionally or alternatively be identified by a switch that is actuated by the insertion of the cooking compartment divider 19 into the cooking compartment 2, in particular with the aid of a plunger.

In the event that the cooking compartment divider 19 is constructed in a modular manner and comprises the base unit 23 and also the accessory units 24, 25, the base unit 23 and/or the accessory units 24, 25 can be identified as separate modules due to the actuation of a further or an additional switch in addition to the resistance measurement that is provided. It is possible to provide different plungers and/or switches.

Moreover, it is also possible to identify a position of the first accessory unit 24 that is designed as an insulation unit. This is to be understood to mean that the identifying facility 22 is configured so as to identify whether the first accessory unit 24 is pointing upwards in the direction of the first cooking compartment section 20 or downwards in the direction of the second cooking compartment section 21. It is possible with the aid of the identification of the cooking compartment divider 19 or the base unit 23 to adapt the types of heating or the display options by the control facility 15 of the household cooking appliance 1 to the functions of the cooking compartment divider 19 or the base unit 23 and the accessory units 24, 25.

For example, it is possible due to the identification of the cooking compartment divider 19 and optionally one of the accessory units 24, 25 for separating the cooking compartment sections 20, 21 to adapt the types of heating of the household cooking appliance 1 and/or the display on the notification display 16 to the operation of the two different cooking compartment sections 20, 21. When the cooking compartment divider 19 is removed, a mode for a normal oven operation is changed into or switched to again.

In the event that the cooking compartment divider 19 is modular or reversible, it is possible due to the identification of the first accessory unit 24 for further types of heating modes or display options to be switched. For example, if the second accessory unit 25 is a pizza stone or a grill plate, the types of heating and the display are adapted on the notification display 16 for this operating mode.

If different accessory units 24, 25 are used in a household cooking appliance 1, it is possible due to a further switch, which is actuated for example by a further or two-stage plunger, to differentiate between these accessory units 24, 25. It is thus possible, in the event that the accessory unit 24, 25 is a pizza stone, to use for example the maximum power of the component 29 while in the case of a grill mode or the use of a contact plate as an accessory unit 24, 25 a reduced power is provided. Moreover, it is possible to ensure that an operation of the household cooking appliance 1 without the respective accessory unit 24, 25 can be identified and optionally is prevented via the evaluation with the aid of the identifying facility 22.

It is possible due to the identification of the cooking compartment divider 19 and its accessory units 24, 25 to adapt the types of heating and/or the display and control options of the household cooking appliance 1. As a consequence, a possible operating error by the user is prevented. Moreover, the operation for the user is facilitated since only options are displayed that are possible in the specific configuration of the cooking compartment divider 19 and its accessory units 24, 25. It is possible due to the identification of the individual accessory units 24, 25 to prevent damage to structural elements of the cooking compartment divider 19 since the component 29 can only be operated in the power range that the component is provided for. If all the accessory units 24, 25 are removed and only the base unit 23 is received in the cooking compartment 2, it is possible, due to the detection possibilities that are provided, to prevent an operation of the cooking compartment divider 19 without an accessory unit 24, 25.

The cooking compartment divider 19 divides the cooking compartment 2 into two separate cooking compartment sections 20, 21 that can be operated in parallel. The second cooking compartment section 21 can be operated for example using top heat, bottom heat, grill heat, grill heat and bottom heat and also intensive bottom heat and consequently comprises an advantage with respect to a passive cooking compartment divider. Furthermore, when the cooking compartment divider 19 is removed, the household cooking appliance 1 can be used as usual. Further use possibilities, which further increase the flexibility of the household cooking appliance 1, are available to the user due to the removal and/or repositioning of the base unit 23 and the insertion of the respective accessory unit 24, 25.

Although the present invention has been described with the aid of exemplary embodiments, the invention can be modified in diverse ways.

The invention claimed is:

1. A household cooking appliance, comprising:

a cooking compartment for receiving food to be cooked;

a cooking compartment divider received in the cooking compartment for dividing the cooking compartment into different cooking compartment sections and designed for removal from the cooking compartment; and an identifying facility configured to identify the cooking compartment divider in the cooking compartment and to adapt an operating state of the household cooking appliance to the cooking compartment divider in response to an identification of the cooking compartment divider, wherein the cooking compartment comprises cooking compartment guide rails mounted in the cooking compartment, wherein the cooking compartment divider comprises a base unit, and wherein the base unit is configured to be inserted into and extracted from the cooking compartment guide rails, wherein the base unit comprises a heating element, wherein the base unit comprises base unit guide rails, and wherein the cooking compartment divider comprises an accessory unit, wherein the accessory unit is configured to be inserted into and extracted from the base unit guide rails.

2. The household cooking appliance of claim 1, constructed in a form of a household oven.

3. The household cooking appliance of claim 1, wherein the identifying facility is configured to mechanically and/or electronically identify the cooking compartment divider.

4. The household cooking appliance of claim 1, wherein the operating state of the household cooking appliance comprises a cooking procedure and/or a display option.

5. The household cooking appliance of claim 1, wherein said identifying facility configured to identify the heating element.

6. The household cooking appliance of claim 5, wherein the identifying facility is configured to perform an electrical resistance measurement on the heating element in order to identify the heating element.

7. The household cooking appliance of claim 1, wherein the accessory unit is at least one of an insulation unit, a grill unit and a pizza baking unit.

8. The household cooking appliance of claim 1, wherein the identifying facility is configured to identify the base unit and/or the accessory unit.

9. The household cooking appliance of claim 1, wherein the identifying facility is configured to identify a model variant of the accessory unit and to adapt the operating state of the household cooking appliance to the model variant.

10. The household cooking appliance of claim 1, wherein the base unit has an opening, wherein the heating element is arranged within the opening, wherein the base unit guide rails are arranged above the opening, and wherein the accessory unit is inserted into the base unit guide rails to cover the opening.

11. The household cooking appliance of claim 1, wherein the household cooking appliance has a rear wall and a door, wherein the cooking compartment has a depth direction extending from the rear wall to the door, wherein the base unit guide rails are oriented in the depth direction, and wherein the accessory unit is inserted and extracted in the depth direction.

12. A cooking appliance, comprising:

a cooking compartment for receiving food to be cooked;

a cooking compartment divider received in the cooking compartment for dividing the cooking compartment into different cooking compartment sections and designed for removal from the cooking compartment; and an identifying facility configured to identify the cooking compartment divider in the cooking compartment and to adapt an operating state of the cooking appliance to the cooking compartment divider in response to an identification of the cooking compartment divider, wherein the cooking compartment comprises cooking compartment guide rails mounted in the cooking compartment, wherein the cooking compartment divider comprises a base unit, and wherein the base unit is configured to be inserted into and extracted from the cooking compartment guide rails, wherein the base unit comprises a heating element, wherein the base unit comprises base unit guide rails, wherein the cooking compartment divider comprises an accessory unit, wherein the accessory unit is configured to be inserted into and extracted from the base unit guide rails, wherein the base unit has an opening, wherein the heating element is arranged within the opening, wherein the base unit guide rails are arranged above the opening, and wherein the accessory unit is inserted into the base unit guide rails to cover the opening, wherein the cooking appliance has a rear wall and a door, wherein the cooking compartment has a depth direction extending from the rear wall to the door, wherein the base unit guide rails are oriented in the depth direction, and wherein the accessory unit is inserted and extracted in the depth direction.

* * * * *